United States Patent [19]

Degenkolb et al.

[11] 4,172,723

[45] Oct. 30, 1979

[54] AUXILIARY DEVELOPER PROCESSING

[75] Inventors: David J. Degenkolb, Mission Hills; Fred J. Scobey, Hollywood, both of Calif.

[73] Assignee: De luxe General, Incorporated, Los Angeles, Calif.

[21] Appl. No.: 925,718

[22] Filed: Jul. 18, 1978

Related U.S. Application Data

[63] Continuation-in-part of Ser. No. 817,874, Jul. 20, 1977, abandoned.

[51] Int. Cl.[2] ..... G03C 7/16; G03C 5/26; G03C 5/30

[52] U.S. Cl. ..... 96/22; 96/50 PT; 96/65; 96/66 R

[58] Field of Search ..... 96/63, 66 R, 22, 4, 96/39, 65, 50 R, 50 PT; 352/38, 56, 40, 44

[56] References Cited

U.S. PATENT DOCUMENTS

| | | | |
|---|---|---|---|
| 1,923,764 | 8/1933 | Troland | 96/63 |
| 1,973,466 | 9/1934 | Crabtree | 96/66.3 |
| 2,238,495 | 4/1941 | Mannes et al. | 96/22 |
| 2,541,490 | 2/1951 | Yule | 96/66 R |
| 3,183,087 | 5/1965 | Lohmer et al. | 96/66.4 |
| 3,574,621 | 4/1971 | Scholler | 96/66.5 |
| 3,671,246 | 6/1972 | Corben et al. | 96/50 |
| 3,716,363 | 2/1973 | Ruggerio | 96/50 |
| 3,740,227 | 6/1973 | Reyes | 96/63 |
| 3,869,288 | 3/1975 | Godowsky | 96/55 |

OTHER PUBLICATIONS

J. Soc. Mot. Pic. Engrs., 21 Jul.–Dec. 1933, pp. 21–53.

Camera 35, Leonian "Comments on Color", Feb./Mar. 1960, pp. 8, 10.

*Primary Examiner*—Mary F. Kelley

*Attorney, Agent, or Firm*—Harry R. Lubcke

[57] ABSTRACT

In the development of color negatives the same are pre-soaked in an acid-inhibited developing agent bath of typically two to four times normal concentration. Subsequent substantially normal development provides up to 2½ stops (six times) greater sensitivity of the emulsion after photographic underexposure. Excessive contrast, grain, and fog are minimized, and necessary tracking parallelism of the contrast curves for the three layers of the color-sensitive emulsion is maintained. Deliberate underexposure in studio motion-picture-making can now be allowed, thereby to effect a highly significant saving of electrical energy in stage lighting.

19 Claims, No Drawings

AUXILIARY DEVELOPER PROCESSING

This is a continuation-in-part of application Ser. No. 817,874, filed July 20, 1977 now abandoned.

BACKGROUND OF THE INVENTION

This invention relates to photographic processing, and more specifically to forced development of multilayer emulsions.

It has been known for years that underexposed silver halide emulsion can be "forced" by overdevelopment to yield a recognizable image when normal development would yield a non-recognizable image. The forcing is accomplished by increasing the temperature of the developing solution above normal, or by increasing the time interval of development, or both.

However, it has been equally well known that the contrast of the forced development image has been excessive, as has been the "grain" of the image. That is, the excessive size of the silver particle groups that give a spurious pattern over the image, having the appearance of a black snow storm.

Further, such forced development has engendered "fog", the known uniform spurious overlay upon the image that masks faint details.

Another disability enters when plural-layer color film is force developed. In the rendition of a color image it is necessary that the straight-line "curves" of a graph of density vs. exposure relation of each of the color components lie in parallel relationships. This is accomplished in normal development.

However, when the development is forced according to the prior art as previously described it is common for two of the curves to intersect at high densities; say the red and the green color components. In the resulting positive print the flesh tones will have a red tone and/or the shadows will have a green tone. Such a condition cannot be remedied. The art describes this situation by saying "the curves no longer 'track'".

At times in the past a "two-part developer" has been used. In such processing the film emulsions are first brought into contact with a first part of the developer. This part has had essentially all of the ingredients for development except for an ingredient that will allow the developer to develop the silver halide. The second part contains only one, or only a few, ingredients, such as only the hydroxyl radical OH.

Immersion of the emulsion in a solution having that ingredient causes development to take place. When the second solution becomes a conventional developer it must be discarded.

It is known that such a process of developing does not result in a significant increase of sensitivity ("speed") of the emulsion(s) involved.

Prior art forcing techniques have often employed "flashing"; i.e. flooding the exposed but not yet developed negative with a weak light in an attempt to correct for forced processing difficulties.

SUMMARY OF THE INVENTION

By a novel relationship that can be termed the "logistics" of the chemical reaction involved in the development process it has been possible to greatly increase the "speed" of emulsions without appreciably engendering the undesired side-effects otherwise obtained in efforts of this nature.

In a preferred mode of this processing the film carrying the emulsion(s) is maintained in contact with a solution of developing agents having of the order of four times normal strength, but held at an acid pH so that actual development does not occur.

This contact is preferably maintained until saturation of the emulsion by the developer is attained. This does not take long in relation to the time interval required for other processing steps.

The film is then passed through the usual developer, in which development takes place.

The result is substantially normal-appearing images, although the negative was under-exposed, usually for inescapable reasons.

By attention to the time interval of these first two steps in the processing an increase in sensitivity of plural times, up to possibly four photographic stops, can be attained.

The contrast of the film image is essentially normal, noticeable grain is absent, and the tracking of the straight-line density vs. exposure curves is maintained by uniform development of each color layer.

Fog is minimal.

The significant result is an image, in color, that has a pleasing appearance and is commercially saleable. This may be a motion picture or a still photograph.

DESCRIPTION OF THE PREFERRED EMBODIMENTS

The significant aspects of this invention has to do with logistic juxtaposition of the principal chemicals involved in relation to the layers of the emulsion.

Such juxtaposition can be brought about either by hand manipulation of emulsion-bearing film, or in continuous processing machines as used in motion picture film processing laboratories.

An example of the latter is the Filmline of Milford, Conn. color negative developing machine utilizing "micro-demand" drive.

In a typical installation for this invention an additional tank system is provided. The tank may contain 1,200 liters of concentrated developing agent solution according to a formula including a paraphenylenediamine, to be detailed later and which includes buffering to an acid pH of approximately 6.2

This is an auxiliary tank, accepting the film ahead of the developer tank of the known processing machine that has been mentioned.

It will be understood that top and bottom rollers, drive rollers, etc., according to the structure of the developer tank can be duplicated for the auxiliary tank. The auxiliary tank is housed in photographically defined darkness, the same as the developer tank.

It is usual that the pre-soak of the film in the auxiliary tank is one-third as long as the subsequent developing period. Thus, the number of rollers defining the length of film in the auxiliary tank may be only one-third as numerous as those in the developer tank.

However, the period of time that the film is in pre-soak in the auxiliary tank is not critical as long as this time is sufficient to allow saturation of the emulsion in all layers by the developer. This may be approximately 45 seconds for a color negative processor.

Moreover, the first imbibed developing agent need not be "concentrated" if the process is arranged to allow for full diffusion of the acid-buffered developer into all photographic layers of the film.

In the processing that has been performed according to this invention, the period during which the emulsion has been in contact with the concentrated developing agent has been within the range of from one-half to three minutes.

Typically, an air squeegee removes the external excess of the first imbibed developing agent solution from the film as it leaves that tank; after which it is immediately immersed in the normal color negative developer, and development starts. It is not necessary that the second solution step here postulated immediately follow the first step. The first step does not invoke chemical reaction; only satuaration of the emulsion with concentrated developing agent that cannot act at once because of the acid pH condition imposed.

The concentrated developing agent is buffered, typically with a sodium and potassium phosphate buffer added to the solution, bringing it to an acid pH of 6.2 The developing agent solution used does not develop unless the solution has a pH in excess of 9; i.e., it is alkaline. Development is thus inhibited in the first imbibed solution.

Upon entering the normal developer solution having a pH in excess of 9, the first imbibed developing agent, being already in situ in the plural layers of the emulsion, immediately starts developing in all of the layers. Uniformity of development of each layer thus occurs and the density vs. exposure "curves" remain parallel straight lines; the desirable situation previously discussed.

It has been determined that the first imbibed developing agent supplies from 60% to 70% of the developing agent required to complete the development of the plural layers of the emulsion. Thus, only 40% to 30% of the second imbibed developing agent needs to subsequently diffuses in.

It is known that when a plural-layer color negative is force-developed by the known prior art expedient of extending the time for development the outer layer develops more than the inner layer(s). This causes the non-parallel tracking that has been mentioned.

With the in situ logistics processing of this invention the photographic development of each layer of the emulsion begins almost simultaneously and progresses vigorously within each layer when the developing agent is activated by the developer.

Prior experiments leading to this invention in which the second solution was merely an OH bath gave only a slight increase in film speed.

In the process of the invention the developer acts as a replenisher to developing agents in situ in the emulsion. The exhausted developing agents diffuse out of the plural layers of the emulsion and the new developing agents diffuse into the same.

This is a different action than were all of the developer required to diffuse into the plural layers as in ordinary development, where a significantly greater proportion of exhausted developer would arrive at the inner layer because it had performed the developing function in the outer layers before arriving at the inner layer.

Experimentally it is known that the contrast of the image remains near normal even though the forced development according to this invention is carried to an increase in sensitivity of up to 4 stops. This has great value in producing a pleasing and commercially useful picture.

It is believed that the stability of contrast with the process of this invention is due to the fact that the film remains in the developer a shorter time interval than it must in order to obtain the same stop increase with the prior art technique of merely extending the development time.

Moreover, it is the overdevelopment of the outer layer(s) that gives the excessive contrast. An excessive contrast in one layer will strongly contribute to the overall contrast, as observed upon looking at the fully processed film or a projection thereof, as in motion picture exhibition.

In passing it is worthy to note that although a color negative responds to the three primary colors as a result of having "three" layers of emulsion of appropriate color-responsive characteristics, it may have more than three layers. It may have six layers, two of differing sensitivity to light and differing other photographic characteristics for each color. There may also be further layers for enhancing the overall performance of the color negative that are not related to a particular color.

Thus, processing according to this invention, wherein fresh and characteristically concentrated developing agent is in situ throughout all layers when development begins is seen to be novel and efficacious.

It has also been observed experimentally that undesirably large grain size, such as accompanies prior forced development processing, is absent in the process according to this invention.

This occurs because the contrast with the present process remains close to normal. The large spurious grain areas do not form because the contrast (the blackness of the silver grains, and/or the equivalent dyes substituted for the silver grains in the color photography) remains close to normal.

As previously mentioned, prior art forcing techniques have usually included "flashing"; i.e., flooding the exposed but not yet developed negative with weak light, typically of red color, as for the Eastman Kodak 5247, Series 500, color negative film. This tends to flatten the cyan curve and reduce the otherwise highly excessive contrast.

The processing of the present invention does not employ flashing at all. The total development process is carried out in photographic darkness. This gives superior results to the prior methods that employ flashing.

At the present time, motion picture studios are under an obligation to reduce the consumption of electric power required to produce the high light levels for filming in color. This is a matter of energy conservation.

With the quality forcing of this invention it is possible for the studios to reduce the lighting level on the stages to only 25% of what has heretofore been used and still to obtain essentially the same quality of exposed color negative. The saving is 75%.

This requires the process of this invention to be carried out only to the extent of 2 stops, which is easily accomplished.

Not only does the lower light level save energy to a very significant degree, but the comfort of the performers is enhanced. This allows them to give longer performances in the "takes" without tiring. Makeup problems are simplified, with lack of perspiration and in other ways. Accordingly, not only is the lighting level reduced, but the time the lighting is required for filming a given motion picture feature is significantly reduced.

Further, in actual night scenes and other scenes that would be photographed at inescapably low light levels the quality of the final resulting film is improved.

Forcing according to the process of this invention can be carried on for 4 stops and beyond. However, the disabilities known to prior art forcing begin to appear in the image in this relatively extreme application of the process.

Hereinabove the time intervals given are for the usual temperature for developing, and this temperature is maintained constant. If the temperature is increased the longer developing times may be decreased in accordance with the known reciprocal relation between time and temperature.

Longer periods of time in the auxiliary tank containing the first imbibed developing agent solution and in the usual developer tank containing the further, second, imbibed developer, may conveniently be achieved by reducing the speed of transport of the motion picture film through the tanks. Of course, substitute tanks with more rollers and thus more film may be used.

EXAMPLE 1

An auxiliary developing agent tank having the approximate dimensions of 180 centimeters (cm) high, 25 cm wide and 75 cm long is provided with 16 top rollers and 15 bottom rollers for carrying 35 mm motion picture film of the Eastman Kodak type 5247, Series 600, that has been exposed in a motion picture camera at least one stop (=0.3 log E) less than optimum exposure.

Within this tank there is 337 liters of developer, having a concentration of approximately four times normal, according to the following formula, special to this invention:

| | |
|---|---|
| Anti-Cal No. 4 (an Eastman Kodak proprietary calcium complexing agent) | 2 mil-liters per liter |
| Sodium sulfite | 5 grams/liter |
| 4-Amino-N-ethyl-N(B Methanesulfonamidoethyl)-m-Toluidine Sesquisulfate Monohydrate; which is Kodak Color Developing Agent CD3 | 8 to 25 gr./ltr. |
| Sodium bromide | 5 gr./ltr. |
| Potassium phosphate, Mono | 34 gr./ltr. |
| Sodium phosphate, Dibasic | 35.5 gr./ltr. |
| Eastman Anti-Fog, No. 9 (proprietary) | 0.22 gr./ltr. |
| pH=6.2 | |

The normal developer tank, which comes after the auxiliary tank in the film path, has the following dimensions and rollers: 180 cm high, 75 cm wide, and 100 cm long, with 64 top rollers and 60 bottom rollers.

That tank contains 1345 liters of Eastman Kodak Color negative developer SD49 (proprietary), which includes CD3 as the developing agent.

The normal speed of traverse of the film through the motion picture developing machine is 38 meters per minute.

This gives a 3 minute traverse through the regular developer tank and a 1 minute traverse through the auxiliary developer tank. This provides the one photographic stop of image enhancement of this example.

A known air squeegee is arranged to blow off substantially all of the concentrated developer that is externally resident upon the film as it emerges from the tank.

The above steps and the compositions of the developers are such that normal color processing can be carried out by the main developing machine by merely omitting the traverse of the film through the auxiliary tank that is peculiar to this invention. Moreover, the auxiliary developer does not contaminate the normal developer in any way, thus allowing normal processing from the chemical standpoint when this is desired.

For the 5247, Series 600, color negative film the temperature of both of the developer solutions is critical and is normally 43° C., plus or minus 0.1° C. The temperature for succeeding baths is not critical and is normally 39° C., plus or minus 2° C.

EXAMPLE 1*a*

The same as Example 1, except that the film is Eastman Kodak 5247, Series 500.

EXAMPLE 2

The same apparatus and formulas as in Example 1 are retained, as is the film type.

The forcing is two photographic stops; a sensitivity increase of four times. This requires a time of 1 minute, 12 seconds in the auxiliary tank and 3 minutes, 40 seconds in the regular developer tank. The concentration of the developing agent CD3 is 20 grams.

EXAMPLE 3

The same apparatus and formulas as in EXample 1 are retained, as is the film type.

The forcing is two and one-half photographic stops, a sensitivity increase of six times. This requires a time of 1 minute, 20 seconds in the auxiliary tank and 4 minutes, 10 seconds in the regular developer tank.

EXAMPLE 4

The same as Example 2, except that the forcing is three stops, and the time is 1 min., 30 sec. in the auxiliary tank and 4 min., 30 sec. in the regular tank.

EXAMPLE 5

The same as Example 2, except that the forcing is four stops, and the time is 1 min., 50 sec. in the auxiliary tank and 5 min., 40 sec. in the regular tank.

EXAMPLE 6

The same as Example 1, except that the negative film is the Fuji type 8517.

The equivalents of examples 2 through 5 are also obtained with the Fuji film, using the same times as for Eastman Kodak.

EXAMPLE 7

The same as Example 6, except that the film is Agfa-Gevaert color negative, type 682.

EXAMPLE 8

The apparatus and other parameters follow Example 1, unless modified hereinafter.

The process is for amateur color film, such as Koda color II, Kodacolor X, Ektacolor; also the professional color films, such as Vericolor II Professional Film, Type S, ditto 5025, Type S, ditto 2107, Type S, ditto 4107, Type S, and equivalent films, as Fuji and 3 M.

The developing agent is CD4 rather than the former CD3.

In this instance the auxiliary tank may contain 50 liters and the normal developer tank 150 liters.

The solution within the auxiliary tank is concentrated and is according to the following formula, special to this invention:

| | |
|---|---|
| Anti-Cal No. 4 (an Eastman Kodak proprietary calcium complexing agent) | 2½ grams per liter |
| Sodium sulfite | 4.25 gr./ltr. |
| 2[(4-Amino-m-tolyl) ethylamino]ethanol sulfate which is Kodak Color Developing Agent CD4 | 8 to 25 gr./ltr. (18 gr./ltr., typical) |
| Sodium bromide | 5 gr./ltr. |
| Potassium Iodide | 2 milligrams/ltr. |
| Hydroxylamine sulfate | 2 gr./ltr. |
| Potassium phosphate, Mono | 34 gr./ltr. |
| Sodium phosphate, Dibasic | 35.5 gr./ltr. |
| pH=6.2 | |

The normal developer tank, which comes after the auxiliary tank in the film path, contains Eastman Kodak C41/C42 developer. This contains CD4 as the developing agent.

For a one stop of image enhancement a 3 minute, 15 second traverse through the regular development tank and a 1 minute, 5 second traverse through the auxiliary tank is used.

EXAMPLE 9

The same apparatus and formulas as in Example 8 are retained, as are the film types.

The forcing is two photographic stops. A 3 min., 55 sec. traverse through the regular development tank and a 1 min., 15 sec. traverse through the auxiliary tank is used.

EXAMPLE 10

The same apparatus and formulas as in Example 8 are retained, as are the film types.

The forcing is two and one-half photographic stops. A 4 min., 20 sec. traverse through the regular development tank and a 1 min., 25 sec. traverse through the auxiliary tank is used.

EXAMPLE 11

The same apparatus and fromulas as in Example 8 are retained, as are the film types.

The forcing is four photographic stops. A 5 min. traverse through the regular development tank and a 1 min., 40 sec. traverse through the auxiliary tank is used.

As to the formulas for the auxiliary (first imbibed, acid pH) first solution of developing agent, it has been mentioned that the concentration thereof need not be more than 1½ times normal if sufficient time is allowed for imbibing.

As a practical matter in commercial film processing; however, the auxiliary developing agent is preferably more concentrated; twice, or preferably four times, more concentrated than the following normal developer.

In a similar manner, the preservative and the restrainer for the developing agent are preferably increased in concentration according to the concentration of the developing agent itself.

The buffer is inactive in the photographic process, and so is merely provided in sufficient amount to surely maintain the auxiliary developer solution at a selected pH. This is preferably only slightly acid, as a pH of 6.2, so that to change to an alkalinity of pH 9, to allow photographic development to occur does not require too much OH radical as a matter of practical chemical logistics. However, the acid pH may have a value within the range of from 4 to 6.9, should any subsidiary circumstance as require.

A suitable sulfite is an alkali metal sulfite, such as sodium or potassium. Sodium sulfite is usually chosen.

This preservative protects the developing agent from spurious oxidation, by being oxidized instead to the sulfate.

A suitable restrainer, to inhibit fog, may be an alkali metal halide, as sodium bromide, sodium iodide, sodium chloride, or corresponding potassium salts. Sodium bromide or potassium iodide are often chosen. Also, a proprietary restrainer may be used, such as the Eastman Kodak AF-9.

Phosphate and acetate buffers may be used. The approximately equal parts of potassium phosphate, mono, and sodium phosphate, dibasic, are chosen herein to give a pH of 6.2.

We claim:

1. The process of developing, in darkness, silver halide photographic color negative film that has an imagewise exposed emulsion, to increase the effective photographic sensitivity plural times with respect to the exposed image thereon, while maintaining the contrast and spurious grain of said exposed image essentially constant, which comprises the method steps of;

(a) imbibing a first solution of a photographic developing agent of the paraphenylenediamine group having a concentration in the range of from 8 to 25 grams per liter into all of said emulsion, under acid pH conditions to totally prevent photographic development of said image, (b) substantially removing the external excess of said first solution, and (c) subsequently imbibing into all of said emulsion under alkaline pH conditions a second liquid-solution of a complete photographic developer having a photographic developing agent of the paraphenylenediamine group at normal concentration of approximately 5 grams per liter;

said second solution chemically composed such that the first imbibed solution does not appreciably alter the chemical composition of said second solution because of residual carry-over of the first solution into the second solution by the film, and also, the imbibing period in the first solution being in the range of from one-third to equal time interval as the normal developing period in the second solution.

2. The process of claim 1, in which said developing agent of said first solution is 4-Amino-N-ethyl-N(B Methanesulfonamidoethyl)-m-Toluidine Sesquisulfate Monohydrate.

3. The process of claim 1, in which said developing agent of said first solution is 2[(4-Amino-m-tolyl)ethylamino]ethanol sulfate.

4. The process of claim 1, in which;

(a) said film has plural separate emulsion layers, and (b) said first solution of developing agent is imbibed substantially equally in each emulsion layer.

5. The process of claim 4, in which;

(a) each of said separate emulsion layers is sensitive to a different color component in the exposure of said film to light.

6. The process of claim 5, in which;

(a) the number of said plural separate emulsion layers is effective in producing three colors.

7. The process of claim 1, in which;

(a) the acid pH condition of the first solution is maintained by a buffer compound.

8. The process of claim 7, in which;

(a) the buffer compound is comprised of dibasic sodium phosphate, and monobasic potassium phosphate.

9. The process of claim 7, in which;

(a) the acid pH condition of the first solution is maintained at approximately 6.2.

10. The process of claim 1, in which the first solution having an acid pH condition is additionally composed of at least, in aqueous solution;

(a) a developing agent preservative in excess of the concentration required for photographic development, to protect the developing agent from spurious oxidation, (b) a restrainer in excess of the concentration required for photographic development, to inhibit the formation of fog caused by the developer reacting on photographically unexposed silver halides in the emulsion, and (c) a buffer to maintain the aqueous solution at an acid pH.

11. The process of claim 1, in which the first solution having an acid pH condition is additionally composed of at least, in aqueous solution;

(a) an alkali metal sulfite in excess of the concentration required for development, to protect the developing agent from spurious oxidation, (b) an alkali metal halide in excess of the concentration required for development as a restrainer to inhibit the formation of fog by the developing agent reacting on photographically unexposed silver salts in the emulsion, and (c) a photographically inert buffer to maintain the aqueous solution at a pH within the range of 4 to 6.9.

12. The process of claim 11, which additionally includes an anti-fog substance.

13. The process of claim 2, in which;

(a) the time interval in said second liquid solution is the same as the normal time interval for development of the film being processed, and (b) the time interval in said first solution is approximately one-third as long as the time interval of the film in said second solution.

14. The process of claim 2, in which;

(a) the time interval in said second liquid solution is extended up to approximately one and one-half times as long as the normal time interval for development of the film being processed, and (b) the time interval in said first solution is approximately one-third as long as the time interval of the film in said second solution.

15. The process of claim 1, in which;

(a) said exposed emulsion is comprised of plural layers, each effective in forming a color component of the imagewise exposure, and (b) said first solution is substantially equally imbibed in each said layer for essentially uniformly developing each layer to maintain tracking parallelism of the straight-line density vs. exposure curves of each said color component.

16. The process of claim 3, in which;

(a) the time interval in said second liquid solution of said film is approximately 3 minutes, 15 seconds, and (b) the time interval in said first solution of said film is approximately 1 minute, 5 seconds.

17. The process of claim 3, in which;

(a) the time interval that said film is in said second liquid solution is approximately 3 minutes, 55 seconds, and (b) the time interval that said film is in said first solution is approximately 1 minute, 15 seconds.

18. The process of claim 3, in which;

(a) the time interval that said film is in said second liquid solution is approximatly 4 minutes, 20 seconds, and (b) the time interval that said film is in said first solution is approximately 1 minute, 25 seconds.

19. The process of claim 3, in which;

(a) the time interval that said film is in said second liquid solution is approximately 5 minutes, and (b) the time interval that said film is in said first solution is approximately 1 minute, 40 seconds.

* * * * *